United States Patent [19]

O'Rourke et al.

[11] 4,405,258

[45] Sep. 20, 1983

[54] METHOD FOR CONTAINING OIL AND/OR GAS WITHIN A BLOW-OUT COVER DOME

[75] Inventors: Cameron O'Rourke; Roger Pilkington, both of Calgary, Calif.X

[73] Assignee: Dome Petroleum Limited, Canada

[21] Appl. No.: 347,930

[22] Filed: Feb. 11, 1982

Related U.S. Application Data

[63] Continuation-in-part of Ser. No. 112,720, Jan. 16, 1980, abandoned.

[30] Foreign Application Priority Data

Oct. 24, 1977 [CA] Canada ..... 289297

[51] Int. Cl.[3] ..... E02B 15/04; E02D 23/02

[52] U.S. Cl. ..... 405/60; 405/203; 405/210

[58] Field of Search ..... 405/60, 203, 205, 207, 405/210, 222, 225; 210/923

[56] References Cited

U.S. PATENT DOCUMENTS

| | | | |
|---|---|---|---|
| 3,664,136 | 5/1972 | Laval et al. | 405/60 |
| 3,681,923 | 8/1972 | Hyde | 405/60 |
| 3,777,497 | 12/1973 | Edwards | 405/210 |
| 3,824,942 | 7/1974 | Stafford et al. | 405/210 |
| 3,981,154 | 9/1976 | Hix | 405/60 |
| 4,047,390 | 9/1977 | Boyce | 405/210 X |

FOREIGN PATENT DOCUMENTS

| | | | |
|---|---|---|---|
| 1063367 | 10/1979 | Canada | 405/60 |

*Primary Examiner*—David H. Corbin

*Attorney, Agent, or Firm*—Lerner, David, Littenberg, Krumholz & Mentlik

[57] ABSTRACT

An improved method for storing a lighter-than-water fluid, e.g., oil, produced from the blowout of an offshore subsea well is provided herein. The method includes the steps of deploying a containment dome in shallow water near the location of the seabed where the containment dome is to be located. The containment dome as an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container, and water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome, while such fluid substantially simultaneously displaces water from within the dome.

9 Claims, 5 Drawing Figures

METHOD FOR CONTAINING OIL AND/OR GAS WITHIN A BLOW-OUT COVER DOME

This application is a continuation-in-part of application Ser. No. 112,720, filed Jan. 16, 1980, now abandoned.

BACKGROUND OF THE INVENTION (i) Field of the Invention

This invention relates to a method for the containment of oil generated by an underwater oil (and gas) blowout of an offshore oil (and gas) well within an offshore oil-containment dome. It relates still further to a method for storing excess oil offshore in such dome.

(ii) Description of the Prior Art

In the event of a blowout from an offshore, underwater well, large quantities of oil and/or gas issue from the subsea location and this creates an environmental pollution problem. This is more acute in the Arctic. In the event of the presence of an ice cover over the blowout, any such oil will be spread below the ice under-surface and more or less be confined by the irregularities in this surface. A boom on the surface could confine most of this oil in open water but would have no effect below the ice. Should such submarine blowout occur, which the blowout prevention hardware of the producing well cannot stop, the standard procedure presently employed is to drill an angled hole to relieve the pressure. This procedure could take several weeks to complete.

Should a blowout of oil occur in the closing weeks of a summer drilling season in the Arctic, however, there might not be sufficient time to drill such relief well. Therefore, the oil blowout could be continuous through the entire freeze-up which averages 200 days per year. The ice in the Beaufort Sea area is in motion during the winter and a serious oil blowout could smear the bottom of the ice and the oil spread over a track of several thousand miles before any remedy could be effected for the blowout or any clean up commenced.

It is therefore desirable to provide a means for the containment of such oil blowout. One solution to such problem was provided by a device provided by one of the present applicants. Such device could be placed over an underwater oil and gas blowout to contain a large quantity of the oil to the vicinity of the plume where the oil can be burned, with such device being able to be placed over a blowout after it occurred. The device was disclosed and claimed in copending Canadian application Ser. No. 270,227 filed Jan. 21, 1977. By that application, a gas containment plume was provided by a device comprising a dome having a peripheral downwardly extending skirt; a central oil outlet tube, such tube having a inlet communication with a floating layer of sub-surface contained oil; means associated with the bottom of such skirt for anchoring such plume over the region of an underwater blowout; a plurality of peripherally disposed, spaced-apart gas outlet valves; and a central control system for operating such gas outlet valves.

That application also provided a method for containing and cleaning oil and gas blowouts from an undersea well by the steps of: (i) setting mooring points around a well location prior to drilling such well; (ii) if a blowout occurs, anchoring the above-described dome over such blowout using such mooring system; (iii) buoying up such dome on a layer of gas and oil under water above the blowout, such dome now being filled with gas; (iv) permitting gas to escape from the periphery of the dome to provide a containment torus on the surface of the water; (v) permitting oil to escape through such central oil outlet tube to the region of the containment torus; and (vi) igniting the gas and oil to clean the oil and gas blowout by continuous burning.

The dome described above in the above-identified Canadian patent application was anchored over the plume close to the sea bed and so was below the moving ice. The device first partially filled with oil and gas. The gas then escaped out through valves around the periphery of the device and formed a circular plume on the water surface which caused strong radially inward surface currents. The oil rose in the center of the gas containment plume (or partially within the gas plume) and so was confined.

However, the need still exists to provide such oil containment dome which could be positioned quickly over a blowout and hold the entire amount of oil and/or gas expelled during the blowout, to allow a controlled escape, if necessary, of the gas in the blowout, to have the collected oil pumped, if desired, into tankers the following summer, and to be removed from the blowout for use at future blowout locations.

SUMMARY OF THE INVENTION (i) Aims of the Invention

It is therefore an object of this invention to provide a method for the control of environmental pollution due to an oil and/or gas well blowout through the use of such a dome.

(ii) Statement of Invention

In accordance with the present invention, a method is therefore provided for storing a lighter-than-water fluid, or containing a lighter-than-water fluid at a predetermined location on the seabed, the containment dome having an upper expanded dome-like fluid impervious membrane, a fluid impervious hollow peripheral ring attached to the periphery of the membrane to provide a depending bag-like container and water drainage means located within the bag-like container for connection to pump conduit means; (B) pumping wet sand from the seabed into the bag-like container, draining water from the wet sand through the water drainage means, so as thereby to provide a body of drained sand disposed within the bag-like container, thereby providing the hollow peripheral ring as a self-supporting structure hollow peripheral torus and as an anchor for the dome-like structural unit; (C) charging the containment dome with a buoyant amount of air; (D) floating the buoyed dome out to the side where the containment dome is to be located; (E) submerging the containment dome by controllably releasing the air while substantially simultaneously filling the containment dome with water, thereby sinking the containment dome until the peripheral hollow torus rests on the seabed at the predetermined location; (F) capturing the lighter-than-water fluid in the dome while substantially simultaneously displacing water from within the dome with the lighter-than-water fluid.

(iii) Other Features of the Invention

In accordance with one feature of the present invention, the dome is disposed over an offshore oil well blowout and/or an offshore gas well blowout, where oil and/or gas is issuing from a location on a seabed, whereby the oil and/or gas is trapped within the dome.

By a feature of the method described above, the peripheral hollow torus is filled with wet sand and wet sand is dewatered by pumping out drained water therefrom in shallow water near the site where the dome is to be deployed.

By another feature, the method includes the steps of charging the dome with a buoyant amount of air and floating the buoyed dome out to the site where it is to be deployed.

By still another feature, the method includes the step of submerging the dome and sinking the dome until the peripheral sandfilled hollow torus rests on the seabed at the site.

By yet another feature, the method includes the step of controllably releasing any gas, but not any oil, issuing from the well and which is captured within the dome.

By still another feature, the method includes the step of controllably releasing oil contained within the dome into a second such dome just prior to the first such dome being filled to capacity.

By yet another feature, the method includes controlling the negative buoyancy of the sandfilled peripheral hollow torus so that it exceeds the maximum buoyancy of the dome when the dome is filled to capacity with the oil.

By another feature, the lighter-than-water fluid is oil and the method includes the step of pumping the oil into the dome and thus substantially simultaneously displacing the water downwardly and outwardly from within the dome through the base of the dome.

By another feature, the method includes the additional step of pumping oil from within the dome, either to a barge, or other retaining vessel floating on the sea, or to another such dome or other domes also anchored on the seabed.

By another feature, the method includes the steps of withdrawing the dome from the predetermined location on the seabed, emptying out the sand, and then storing the dome in collapsed form for future use.

By yet another feature, the dome is withdrawn from the predetermined location on the seabed by filling the dome with air, thereby buoying up the dome to the sea surface, and then removing the buoyed up floating dome to a shallow water location.

By a further feature thereof, the method includes the steps of flushing the sand from the bag-like container by injecting water into the bag-like container, thereby removing the sand, emptying the water from within the bag-like container, and then folding the dome membrane and storing the folded membrane for future use.

(iv) Brief Description of These Other Features

One particularly well-suited material out of which the dome may be made is nylon-reinforced neoprene, a chloroprene elastomeric polymer. It is essential, for the purpose of storing oil, that the One especially desirable material is a fabric made of KEVLAR (registered Trade Mark) that can be coated with neoprene on the outside and a nitrile rubber on the inside to give na overall thickness of approximately ⅛ inch. KEVLAR is a high strength man-made fibre. It is reported to exceed the strength of steel on a weight-for-weight basis. There is now commercially available a fabric of woven KEVLAR with a strength of about 3,000 pounds per inch width.

Neoprene is a good all-purpose synthetic rubber with good resistance to both oil and abrasion. Nitrile rubber is variously known as acrylonitrilebutadiene rubber; butadiene-acrylonitrile copolymer elastomer; nitrile-butadiene rubber; NR; and NBR. It is a synthetic rubber made by the polymerization of acrylonitrile with butadiene. Its repeating structure may be represented as $-CH_2CH=CHCH_2CH_2CH(CN)-$. Two well-known commercial varieties are known by the Trade Marks of HYCAR and CHEMIGUM. Nitrile rubber is highly resistance to oil. The fabric plus the coating would weigh about 0.75 pounds per square foot, giving an overall weight of about 23 to about 25 tons for a dome of this invention.

The coherent non-settable particulate material contained in the peripheral anchoring ring is preferably medium-to-coarse sand rendered coherent by the procedure disclosed in Canadian Pat. No. 1,010,667 issued May 24, 1977 to B. E. W. Dowse. As taught in that patent, sand is poured into the fluid impervious membrane and water is pumped out with a submersible pump installed in a pipe with a perforated bottom. Once the confined sand is drained, the lateral pressure it exerts is only about one-half the hydrostatic pressure of the surrounding water. However, that pressure is used to keep the sand together.

BRIEF DESCRIPTION OF THE DRAWINGS

In the accompanying drawings.

Figure 1:
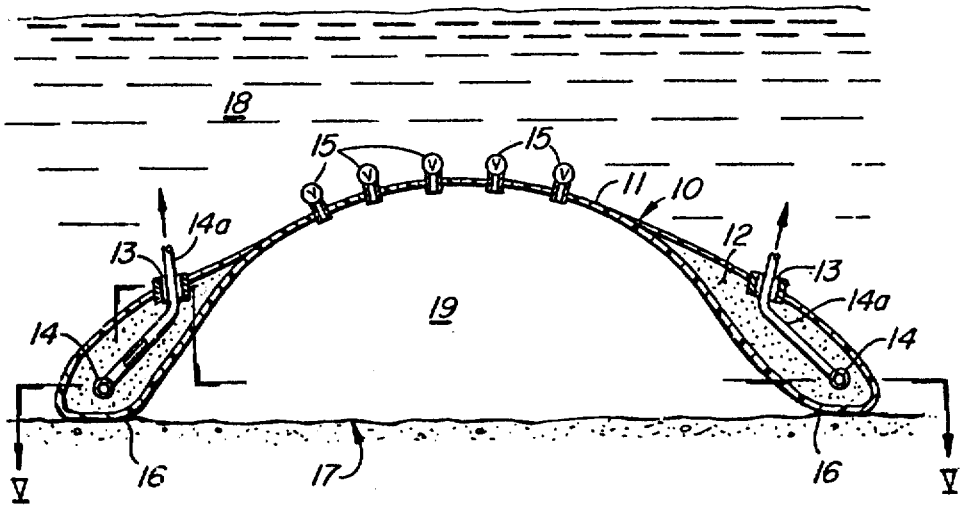
FIG. 1 is a central vertical section through an oil containment dome of an embodiment of the present invention.

DESCRIPTION OF PREFERRED EMBODIMENTS (i) Description of FIG. 1

As seen in FIG. 1, the dome 10 is generally hemispherical or paraboloidal in shape and includes a dome membrane 11, of fluid impervious material (as hereinbefore exemplified) and a peripheral hollow torus (as hereinbefore defined) forming a bag 12, also formed of fluid impervious material. The hollow peripheral torus forming the bag 12 is provided with wet sand inlet tube 13. A perforated water drainage pipe 14, which is a perforated ring-like conduit, is provided near the base 16 of the bag 12. This ring-like conduit 14 is connected to the suction end of a pump (not shown) by means of conduit **14*a* which passes sealingly, concentrically through wet sand inlet tube 13. The operation thereof will be described hereinafter with reference to FIG. 2**.

The dome membrane 11 is provided with one-way gas relief valves 15. As shown, the dome 10 rests with the base 16 of the hollow peripheral torus 12 on a seabed 17 below the surface of the water 18.

The dome 10 may be used to store any lighter-than-water fluid, or to cover an out-of-control well (not shown). The dome 10 is designed such that the negative buoyancy from the sand-filled hollow peripheral torus 12 should preferably exceed the maximum buoyancy of any oil inside the dome 10 even when the dome 10 is filled to capacity.

Figure 2:
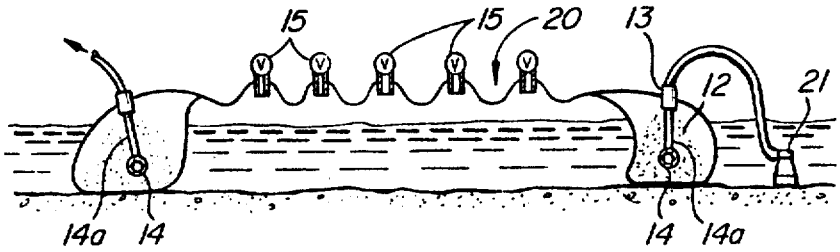
FIG. 2 is a central vertical section through a collapsed oil containment dome of an embodiment of the invention, in a preliminary stage of its erection.
Figure 3:
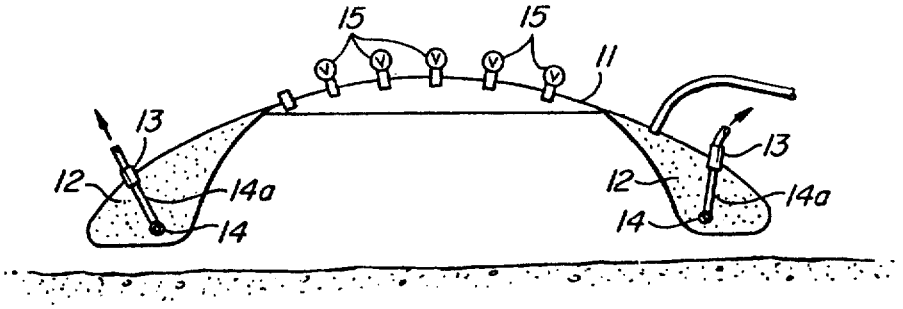
FIG. 3 is a central vertical section through an erected oil containment dome of the embodiment of the invention shown in FIG. 2.

(ii) Description of FIGS. 2 and 3

As seen in FIGS. 2 and 3, the precursor structure 20 of the dome 10 is stored in a collapsed state prior to use. When required, the precursor structure 20 is taken out to a site where water depth is approximately equal to the vertical height of the hollow peripheral torus 12, as close as possible to the area where the dome 10 will subsequently be installed. Sand and water are pumped into the hollow peripheral torus 12 by means of a sand pump 21 via tubes 22 through inlet tubes 13. During the pumping operation, water drains from the sand into the perforated water drainage pipe 14 through its perforated walls, and is drawn up through conduits 14a and away from the composite coherent body of sand by means of the suction side of the pump 21. The pump continues to carry away any water drained from the body of sand filling the dome membrane 11. By drawing the water from the body of sand, build-up of the pore water pressure in the sand is reduced with a corresponding maintenance of a suitable level of the internal shear strength of the partially drained sand body under the confinement of the hydrostatic pressure acting on the outside of the peripheral hollow torus 12, thereby enabling the dome 10 to be self-supporting.

Figure 4:
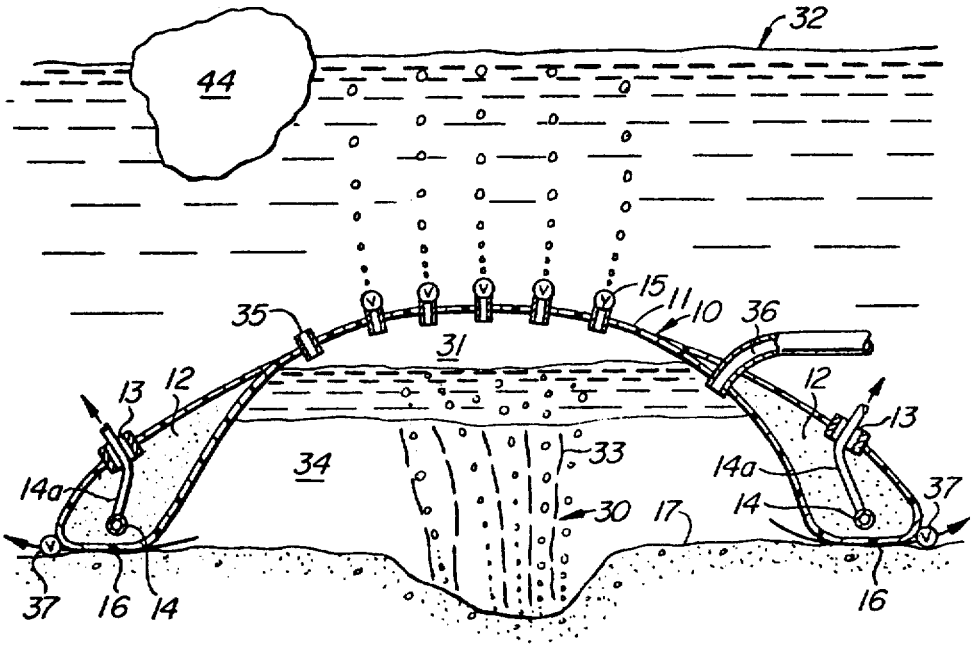
FIG. 4 is a central vertical section through an oil containment dome of an embodiment of the invention used to contain an oil and gas blowout.
Figure 5:
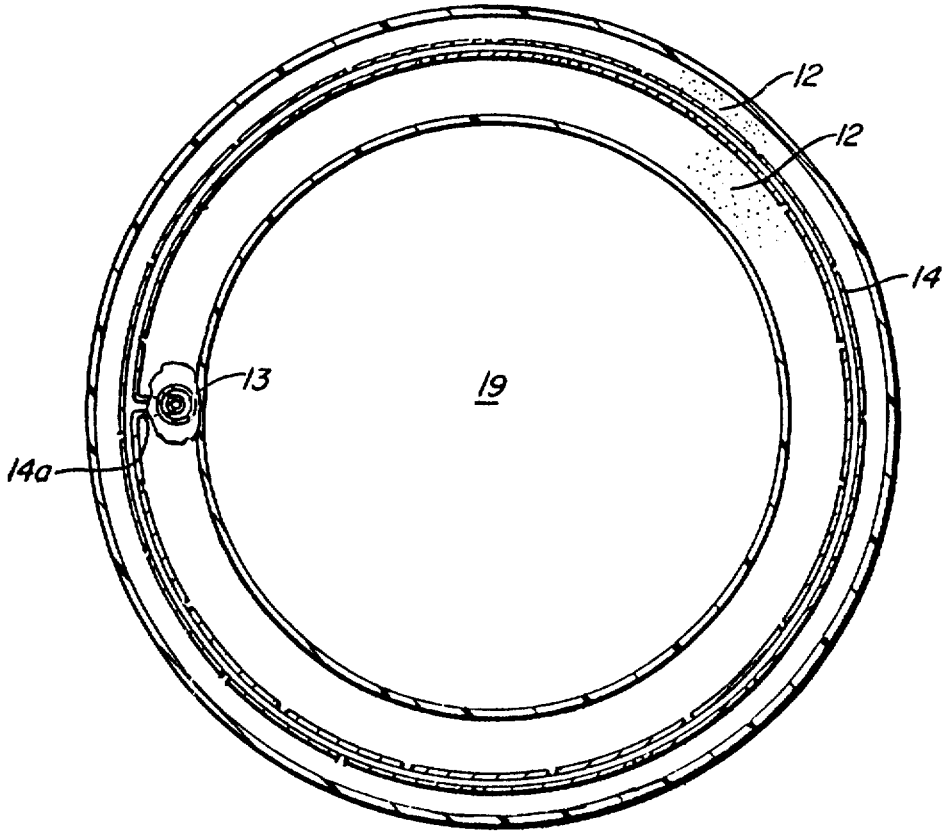
FIG. 5 is a central horizontal section taken along lines V—V in FIG. 1.

(iii) Description of FIG. 4

As seen in FIG. 4, in the oil well blowout application, the dome 10 is placed over the blowing wellhead 30. A plurality of valves 15 in the dome membrane 11 controllably release gas or air 31 to the surface 32 of the water 18 continuously but yet operate such as to prevent the oil 33 from passing out. As oil 33 blows into the dome 10, the oil 33 will rise in the lower portion 34 of dome 10 and substantially simultaneously displace water below the base 16 of hollow tube 12 via valve 37 or through vents 35 near the top of the peripheral sand-filled ring 12. The dome 10 may be emptied of the oil from valved pipe 36 near the top of the dome 10, as required, to a barge or other vessel (not shown) on the sea surface or to other similar dome or domes (not shown) on the seabed 17.

Operation of Preferred Embodiments

The dome structure 10 is particularly applicable to blowouts occurring in ice-infested waters, e.g. the Arctic Ocean, as the dome 10 rests on the sea floor 17 below any moving ice 44. In this application, one or more such domes may be placed on the seabed, (one to cover the blowout and to contain oil, the others to act as storage tanks into which captured oil can be pumped) to contain all of the oil expected from the blowout while the blowout side is ice covered.

If the oil flow from the blowout is higher than expected and causes the dome or domes 10 to fill to capacity, and it is impossible to get to the well site, a valve 35 in the top of the dome opens, releasing all oil in the dome.

After use at a specific location, whether that be for storing some lighter-than-water fluid or for containing oil from a subsea blowout, the dome can be lifted off the seabed by air pressure, floated to shallow water, the peripheral tube emptied of sand and the structure material folded and stored for future use.

DESCRIPTION OF PREFERRED EMBODIMENT

For oil wells in the Beaufort Sea area of the Arctic, it has been estimated that a blowout may involve the flow of about 2,500 barrels a day decreasing to about 1,000 barrels a day after thirty days and running at this level indefinitely. Thus, the dome should preferably have a paraboloid shape, with the peripheral hollow tube filled with dewatered sand having a submerged weight of about 7,000 tons. The dome should preferably have the following approximate dimensions:

| | |
|---|---|
| Overall diameter | 200 feet |
| Overall height | 60 feet |
| Volume | 222,500 barrels |
| Diameter of a peripheral ring | 25 feet |
| Overall area | 67,000 square feet |

On completion of sand filling, the sand-filled peripheral ring acts as structural anchor member with the sand under triaxial compression. Air pressure is then applied to inflate the dome and ultimately to float the dome to location. Based on the area and weight of the sand, an air pressure of about 3.5 pounds per square inch would be sufficient to float the structure. This operation would put the dome under its full working stress.

On location, in one embodiment of this invention, the dome is positioned over the blowout and by gradually letting the air out, it would be sunk.

The dome should require no maintenance during the winter. If the top of the dome is touched by the underside of an ice pressure ridge, it should deform without damage, providing the gas valves are protected.

Thus, a dome is provided which includes a sand-filled peripheral anchor ring that could store about 200 days of blowout as defined for the Beaufort Sea.

The dome is easily stored, and it is estimated that the structure could be in place within one week of a blowout occurring. After use, the oil can be pumped from the top of the dome, the whole structure towed to shallow water, the sand pumped out, and the collapsed structure stored for future use. After use, the sand can be pumped out of the peripheral ring either on location or in shallower water.

The concept of the present invention also provides a dome of a wide variety of sizes and shapes for use by oil and other industries for offshore storage of oil. This invention thus has considerably commercial potential, not only in the Beaufort Sea, but in every area of the world where there is offshore exploration and production of oil.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A method for containing a lighter-than-water fluid at a predetermined location on the seabed, which method comprises:

(A) deploying a containment dome in shallow water near said predetermined location on the seabed, said containment dome having an upper expanded dome-like fluid impervious membrane, a fluid impervious hollow peripheral ring attached to the periphery of the membrane to provide a depending bag-like container and water drainage means located within said bag-like container for connection to pump conduit means;

(B) pumping wet sand from said seabed into said bag-like container, draining water from said wet sand through said water drainage means, so as thereby to provide a body of drained sand disposed within said bag-like container, thereby providing said hollow peripheral ring as a self-supporting structure hollow peripheral torus and as an anchor for said dome-like structural unit;

(C) charging said containment dome with a buoyant amount of air;

(D) floating said buoyed dome out to the site where said containment dome is to be located;

(E) submerging said containment dome by controllably releasing said air while substantially simultaneously filling said containment dome with water, thereby sinking said containment dome until said peripheral hollow torus rests on the seabed at said predetermined location;

(F) capturing said lighter-than-water fluid in said dome while substantially simultaneously displacing water from within said dome with said lighter-than-water fluid.

2. The method of claim 1 wherein said lighter-than-water fluid is oil which is issuing from a blowout of an offshore subsea well at said predetermined location on the seabed, and including the step of controllably releasing any gas issuing from said predetermined location and which is captured within said dome, while preventing the release of any oil therefrom.

3. The method of claim 2 including the step of controllably releasing oil contained within said dome into a second such dome prior to said first dome being filled to capacity.

4. The method of claim 2 including controlling the negative buoyancy of said sand-filled peripheral hollow peripheral torus so that it exceeds the maximum buoyancy from said dome when said dome is filled to capacity with said oil.

5. The method of claim 1 wherein said lighter-than-water fluid comprises oil, and including the steps of pumping said oil into said dome and thus substantially simultaneously displacing the water downwardly and outwardly from within said dome through the base of said dome.

6. The method of claim 5 including the additional step of pumping said oil from said dome to a barge or other vessel floating on the sea, or to another similar dome or other domes anchored on the seabed.

7. The method of claim 1 including withdrawing said dome from said predetermined location on said seabed, emptying out said sand, and storing said dome in collapsed form for future use.

8. The method of claim 7 wherein said dome is withdrawn from said predetermined location on said seabed by filling said dome with air, thereby buoying up said dome to the sea surface, and then moving said buoyed up floating dome to a shallow water location.

9. The method of claim 8 including the steps of flushing said sand from said bag-like container by injecting water into said bag-like container, thereby removing said sand, emptying said water from within said bag-like container, and then folding said dome membrane and storing said folded membrane for future use.

* * * * *